US009051031B1

(12) United States Patent
Dooley

(10) Patent No.: US 9,051,031 B1
(45) Date of Patent: Jun. 9, 2015

(54) ROTARY CAPTURE DEVICE WITH PASSIVE ENGAGEMENT AND ACTIVE RELEASE

(71) Applicant: Richard E. Dooley, Portsmouth, RI (US)

(72) Inventor: Richard E. Dooley, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/215,259

(22) Filed: Mar. 17, 2014

(51) Int. Cl.
*B63B 21/56* (2006.01)

(52) U.S. Cl.
CPC ..... *B63B 21/56* (2013.01)

(58) Field of Classification Search
CPC ..... B63B 21/60
USPC ..... 114/253, 249
See application file for complete search history.

(56) References Cited

U.S. PATENT DOCUMENTS 3,653,101 A * 4/1972 Mayo ..... 114/230.3
3,762,757 A * 10/1973 Epstein ..... 294/82.33
3,868,922 A * 3/1975 Schulz ..... 114/249
3,918,386 A * 11/1975 McClain ..... 114/230.3
4,677,930 A * 7/1987 Ortloff ..... 114/230.14
5,082,318 A * 1/1992 Held et al. ..... 294/191
5,123,374 A * 6/1992 McMillan ..... 114/230.3
7,798,085 B2 * 9/2010 Burnette ..... 114/230.21
8,746,766 B2 * 6/2014 Lewkoski ..... 294/33

* cited by examiner

*Primary Examiner* — Lars A Olson
*Assistant Examiner* — Jovon Hayes
(74) *Attorney, Agent, or Firm* — James M. Kasischke; Michael P. Stanley

(57) ABSTRACT

A vehicle recovery system is provided which includes a capture device having a body with two arms defining an open ended cavity with a shaft attached to and between each of the arms and extending through the cavity. A tow line is attached to the body opposite the cavity and a buoyant member disposed in the cavity and rotatable around the shaft. A plurality of capture loops disposed within the cavity are rotatable with the buoyant member and define closed loops with the buoyant member. A spring-loaded towing latch is attached to the vehicle to be recovered. The latch includes a hook having a first open position and a second closed position. The hook is moveable from the first position to the second position under action of a biasing spring upon engagement of one of the capture loops over the hook.

12 Claims, 3 Drawing Sheets

ROTARY CAPTURE DEVICE WITH PASSIVE ENGAGEMENT AND ACTIVE RELEASE

STATEMENT OF GOVERNMENT INTEREST

The invention described herein may be manufactured and used by or for the Government of the United States of America for Governmental purposes without the payment of any royalties thereon or therefore.

BACKGROUND OF INVENTION

1) Field of the Invention

The present invention is directed to vehicle recovery systems. Specifically, the present invention relates to a vehicle recovery system having a rotary capture device compatible with a passive engagement and an active release device of a vehicle to be recovered.

2) Description of Prior Art

Unmanned Surface Vehicles (USV) provide an expanding range of applications. However, USVs face a challenge when deployed from and recovered by larger vehicles such as ships—especially when the vessels are operating in varying sea states. Therefore, a reliable, robust and simple system for transitioning between self-propelled and captured states is necessary for mission effectiveness.

Mayo (U.S. Pat. No. 3,653,101) recites a quick-release, self-locking hook attached to a buoy which is connected to an embedded anchor by a heavy chain or wire rope. The cited reference is directed to a self-locking capability to attempt to eliminate the necessity of human intervention in the locking process. The reference recites that this is accomplished by providing a locking keeper that is pivotable for full rotation.

Epstein (U.S. Pat. No. 3,762,757), recites that in the mooring of ships and boats to a dock, it is necessary to have a line run from the ship or boat to the dock. The line can be more or less tight and must be fixed so as to allow relatively little movement of the ship or boat with respect to the dock. When it is necessary to allow the ship or boat to move away from the dock, it is also necessary to disengage the line from the fastening means on the dock. This reference relates to a fastening means whereby a line can be positioned to the fastening means for securing the ship or boat adjacent to the dock. Then, the person on the dock can mechanically actuate the fastening means to allow the line to slip away from the fastening means and also to allow the ship or boat to sail away from the dock. This fastening means is identified as a releasable hook. When it is desired to have a ship or boat fixedly secured with respect to the dock; the fastening means is in a locked position to firmly position the line. When it is desired to allow the line to be slipped and to allow the ship or boat to sail away from the dock; the operator on the dock can disengage the fastening means, or releasable hook from the line.

Schulz (U.S. Pat. No. 3,868,922), discloses an automatic latch/unlatch mechanism comprising a housing having a plurality of latches pivotally attached thereto. A probe inserted into the housing at a specific first distance and moved in the opposite direction at a specific second distance, is engaged by the latches and prevented from being extracted from the housing. Then, if the probe is moved at a specific third distance into the housing; the probe may be extracted therefrom.

McClain (U.S. Pat. No. 3,918,386), recites a boat docking device mounted on the bow of a boat with the device comprising a housing member having forward surfaces slanting inwardly to a slot for receiving a mooring line, a latch pivotally mounted in the housing member between a locked and unlocked position, and a retractable biased pin urged against the locking member for securing the latch in a locked position.

Ortloff (U.S. Pat. No. 4,677,930) recites an apparatus for securing two offshore mooring sections together. The apparatus is a connector adapted to disengage each mooring section so that an offshore floating storage vessel (having one mooring section attached) may be separated from the riser of a single anchor leg mooring system—having the other mooring section attached. The connector comprises a pin member engageable with a hook of a latch member. The latch member is rotated once the hook engages the pin member and a plunger then advances into an open region of the hook; thereby, prohibiting the rotational movement of the latch member and locking the two mooring sections together.

In Held et al. (U.S. Pat. No. 5,082,318), a girth hitch is secured about an object by a girth hitching mechanism having a rotatable actuator gate which displaces a latch gate that has a parrot hook that loosely supports a portion of a closed girth loop. A latch ring joined to the girth loop by a latch ring bite is engaged by the parrot hook when the latch gate and actuator gate are rotatably displaced as the object enters the throat of a fork which supports the latch gate, actuator gate and latch ring. After the parrot hook engages the latch ring and the latch gate is rotated in the opposite direction by the object to disengage the latch ring, the girth loop is pulled from its loose support on the parrot hook into a girth hitch configuration about the object to enable recovery via an attached lift line.

In McMillan (U.S. Pat. No. 5,123,374), a releasable toggle locking mooring hook is provided having a releasable hook, toggle linkage, a stop release mechanism, a self-locking safety latch and a self release mechanism adapted to provide a locking mooring hook and a releasing means while a mooring hook is under a tensile load. In the mooring of ships, boats and barges to a dock or oil well platform, a line, usually under tension, is run from the ship to a mooring means mounted on the dock or platform. When it is desired that the ship leave this mooring, this mooring means can be actuated manually, mechanically or by a pre-set tensioned self releasing means to release mooring line and thus, allow the ship to sail. This mooring means is identified as a releasable toggle locking mooring hook.

SUMMARY OF THE INVENTION

Exemplary embodiments of a system and method of use in accordance with the present invention are directed to a surface vehicle capture device compatible with a passive engagement and an active release device of a vehicle to be towed. In one embodiment, the capture device utilizes a recovery tow line secured to a U-shaped body or fork that is coupled to a buoyant rotor. The buoyant member is shaft-mounted in a cavity defined by two arms of the U-shaped body to which the shaft is fixedly or rotatably attached. Capture loops are pinned on ends of an outer surface of the buoyant member.

As the capture device is dragged thru the water; the buoyant member provides flotation. The capture loops provide asymmetric drag; thereby, rotating the buoyant member and capture loops around the shaft. As a vehicle approaches to latch with the capture device; a primary latch and a stem guard of a spring-loaded secondary latch (on the vehicle to be recovered) guide at least one of the capture loops into the primary latch. The secondary latch is displaced as the capture loop enters and then spring loads to a locking position that "captures" the capture loop. This capture mechanically brings the vehicle into a controlled tow.

To release the capture loop, the primary latch is freed by an actuator that releases a mechanical stop. This action allows the primary latch to rotate about a pin. Once released, the system resets for capture by reversing the action of the actuator and torsional springs.

An advantage of the present recovery system is that passive latching is achieved by simply positioning the craft bow in proximity to the capture device. No active reset of the device is needed when a miss occurs in the docking procedure. Active system control is only used to release the recovered vehicle from the capture device.

The material of the capture loops can be synthetic line, wire rope or formed solid rods. Paddle size can be varied to control rotational velocity and wake signature; preferably with the least amount of drag and the most stable over the broadest range of recovery speeds. Also, positioning of the paddles on the drum can be used to control rotational velocity and wake signature. The capture device can be towed alone or coupled to other recovery equipment.

An integral passive pump can be used to enhance a recovery effect. Some types of personal water craft have a diversion outlet that sends a portion of the propulsion water jet into the air (allowing an increase the visibility of the watercraft). In the present invention, two streams of water from the vessel with the capture loops; form fluid guide posts for a visual recovery of the vessel to be towed.

BRIEF DESCRIPTION OF THE DRAWINGS

It will be understood that many additional changes in details, materials, steps, and arrangements of parts which have been described herein and illustrated in order to explain the nature of the invention, may be made by those skilled in the art within the principle and scope of the invention as expressed in the appended claims:

DETAILED DESCRIPTION OF THE INVENTION

In the description which follows, any reference to either direction or orientation is intended primarily and solely for purposes of illustration and is not intended in any way as a limitation on the scope of the present invention. The particular embodiments described herein, although being preferred, are not to be considered as limiting the present invention.

Figure 1:
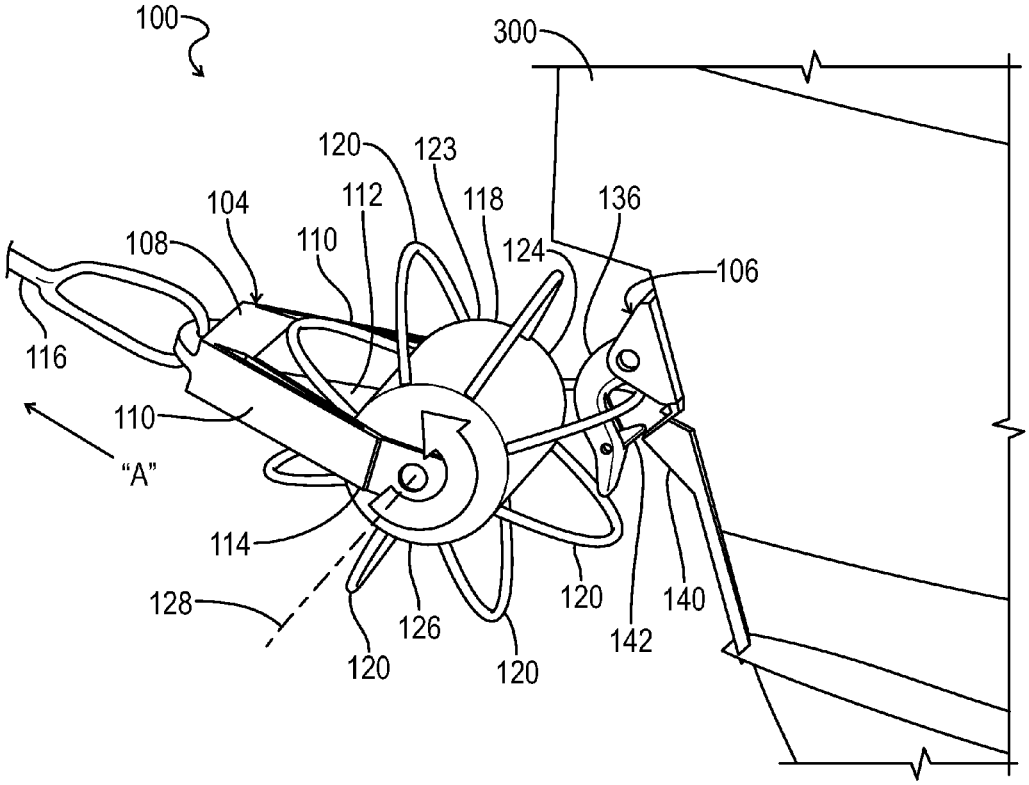
FIG. 1 is a perspective view of an embodiment of a vehicle capture system in accordance with the present invention.

Referring initially to FIG. 1, the present invention is directed to a system 100 for recovery of a vehicle 300. Suitable recovery vehicles (not shown) include, but are not limited to, a surface vessel such as a ship or a boat, or an undersea vessel such as a submarine. Recovery vehicles include manned and unmanned vehicles.

The system 100 comprises a capture device 104 and a spring-loaded towing latch 106. The capture device 104 is a U-shaped body 108 arranged with opposing arms 110 that are spaced from each other to define an open-ended cavity 112. A shaft 114 is attached to each one of the two arms 110 and extends through the cavity 112. The shaft 114 can be fixedly attached or rotatably attached to each arm 110.

The capture device 104 includes a tow line 116 attached to the U-shaped body 108 opposite the cavity 112. The tow line 116 attaches at another end to the towing vessel. The tow line 116 is deployable and retractable from the towing vessel—for example, from a spooling mechanism attached to the towing vessel. Suitable tow lines are known in the art.

The capture device 104 includes a buoyant member 118 rotatably disposed in the cavity 112. In one embodiment, the shaft 114 is fixed and the buoyant member 118 rotates around the fixed shaft. Alternatively, the buoyant member 118 is fixedly attached to the shaft 114, and the shaft rotates.

The capture device 104 includes a plurality of capture loops 120 disposed to fit and easily move within the cavity 112. Each of the capture loops 120 are attached to the buoyant member 118 and the shaft 114 and are rotatable with the buoyant member. Each capture loop 120 and the buoyant member 118 define a closed loop. These closed loops are capable of engaging the spring-loaded latch 106 that is attached to the vehicle 300.

The buoyant member 118 is a cylindrical drum having an outer surface 123 and two ends (a first end 124 and a second end 126). The first and second ends 124, 126 are circular and preferably are formed as semi-spherical caps. The cylindrical drum and the ends 124, 126 can be formed as a sealed unit to create buoyancy or can be constructed of or covered by a buoyant material.

A central axis 128 passes through the cylindrical drum between the ends 124, 126. The shaft 114 extends through the ends 124, 126 along the central axis 128. In one embodiment, each capture loop 120 is formed from a curved rod attached to the outer surface 123 of the cylindrical drum at two locations.

A first location is disposed adjacent to the first end 124 of the cylindrical drum and a second location is disposed adjacent the second end 126 of the cylindrical drum. Each curved rod extends along the outer surface 123 of the cylindrical drum along a line parallel to the central axis 128 and extends radially outward from outer surface of the cylindrical drum to form an arched shape defining the closed loop.

In one embodiment, the capture loops 120 also provide for rotation of the buoyant member 118 and the attached capture loops within the U-shaped body 108. As the capture device 104 is pulled along the water surface by the tow line 116 in the direction of travel "A" of the recovery vessel and the captured vehicle 300; a corresponding rotational motion is induced in the buoyant member 118 and the capture loops 120. As illustrated, each capture loop 120 is moved vertically out of the water surface. This rotational motion facilitates engagement in the downwardly-facing and spring-loaded towing latch 106.

In one embodiment, the buoyant member 118 and the capture loops are sized and shaped to rotate about the shaft 114 at a predefined rotation speed. The rotational speed of the buoyant member 118 is preferably thirty rotations per minute. The diameter of the buoyant member 118 is the perimeter of the buoyant member. The speed of a towing action provides a distance over time while the perimeters give revolutions over time as a RPM (revolutions per minute).

Suitable materials for the U-shaped body 108, the shaft 114, and the buoyant member 118 include, but are not limited to a buoyant material, aluminum, titanium, carbon fiber, a polymer and combinations thereof. Suitable materials for the capture loop 120 include, but are not limited to, a synthetic line, a wire rope and a formed solid metal rod.

Figure 2:
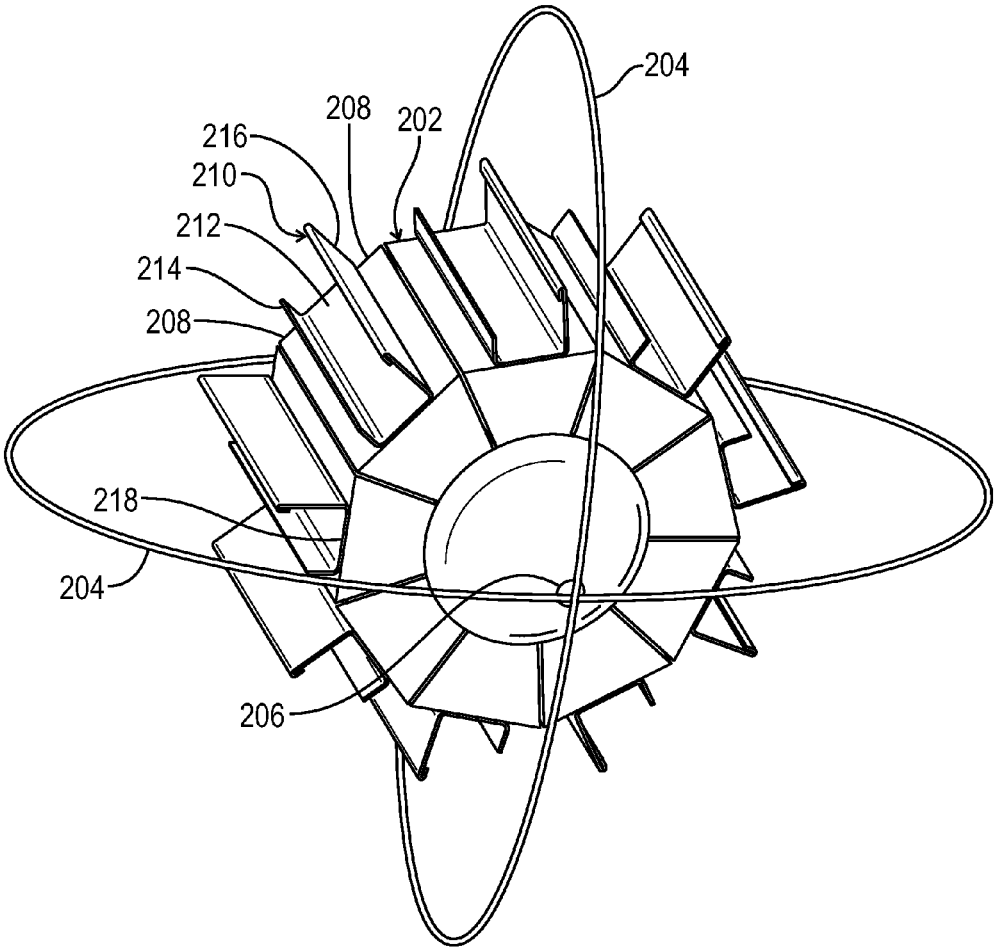
FIG. 2 is a perspective view of an alternative embodiment of the buoyant member of the vehicle capture system.

Referring to FIG. 2, an alternative embodiment of a capture device with a buoyant member 202 and capture loops 204 is illustrated. The buoyant member 202 includes at least one paddle 210, and preferably a plurality of paddles, attached to and extending out from the buoyant member. The paddles 210 are separate from the capture loops 204. The capture device includes a cylindrical drum having an outer surface and two ends. A central axis passes through the cylindrical drum between the two ends, and a shaft 206 extends through the two ends along the central axis.

Each paddle 210 is a solid plate extending radially outward from the outer surface of the cylindrical drum and along the outer surface of the drum between the two ends parallel to the central axis. In one embodiment, each paddle 210 has a central portion 212 attached to the buoyant member 202 and two parallel plates extending outwardly from the central portion on two parallel planes. A first plate 216 extends outwardly from the central portion at a first distance and a second plate 214 extends outwardly from the central portion a second distance. The first distance is greater than the second distance.

The cylindrical drum includes a plurality of distinct wedge-shaped segments 208 that are fitted together to define the outer surface of the buoyant member 202. In one embodiment, the wedge-shaped segments 208 are fitted over a cylindrical central portion 218 of the buoyant member 202. These wedge-shaped segments 208 can be formed from a buoyant material with the paddles 210 attached to the wedge-shaped segments.

As illustrated, the buoyant member 202 is fixedly attached to the shaft 206, and the shaft is configured to rotatably engage with the two arms 110 of the U-shaped body 108. Each capture loop 204 is also fixedly attached to the shaft 206. Therefore, rotation of the shaft 206 rotates the buoyant member 202 and the capture loops 204. The paddles 210 induce rotation of the buoyant member 210. The use of paddles allows the use of fewer capture loops 204, thinner or larger capture loops or capture loops formed of a flexible material such as wire rope as the capture loops are not used to induce rotation of the buoyant member 202.

Returning to FIG. 1; the spring-loaded towing latch 106 is attached to the vehicle 300. Preferably, the towing latch 106 is mounted to the hull at the bow—near or above the water line. Therefore, the capture device 104 being pulled behind the tow vessel is extended rearward to engage the forward facing spring-loaded latch 106. The arrangement of the towing latch 106 and capture loops 120 provide for passive latching of the capture device 104 in the towing latch. No active closure or reset of the towing latch 106 is needed to engage the capture device 104 or to reset the towing latch following a miss during a docking procedure. Active control is only used to release the capture device 104 from the towing latch 106.

In general, the towing latch 106 includes a moveable hook having a first open position and a second closed position. The hook is moveable from the first position to the second position under action of a biasing spring upon engagement of one of the capture loops over the hook. As illustrated in FIG. 1, the hook includes a primary latch 136 with a stem guard portion 140 to capture one of the loops 120. The hook, and in particular the primary latch 136, is pivotable away from the stem guard portion 140 to facilitate release of the capture loops 120.

The towing latch 106 also includes a secondary latch 142 attached to the primary latch 136. The secondary latch 142 is biased in a locked position away from the hook by a biasing spring. The secondary latch 142 moves toward the hook to allow passage of one of the capture loops 120 for engagement of the hook and securing of the capture loop in the towing latch 106. When the secondary latch 142 returns to an original biased position; the capture loop 120 is secured in the hook.

Figure 3:
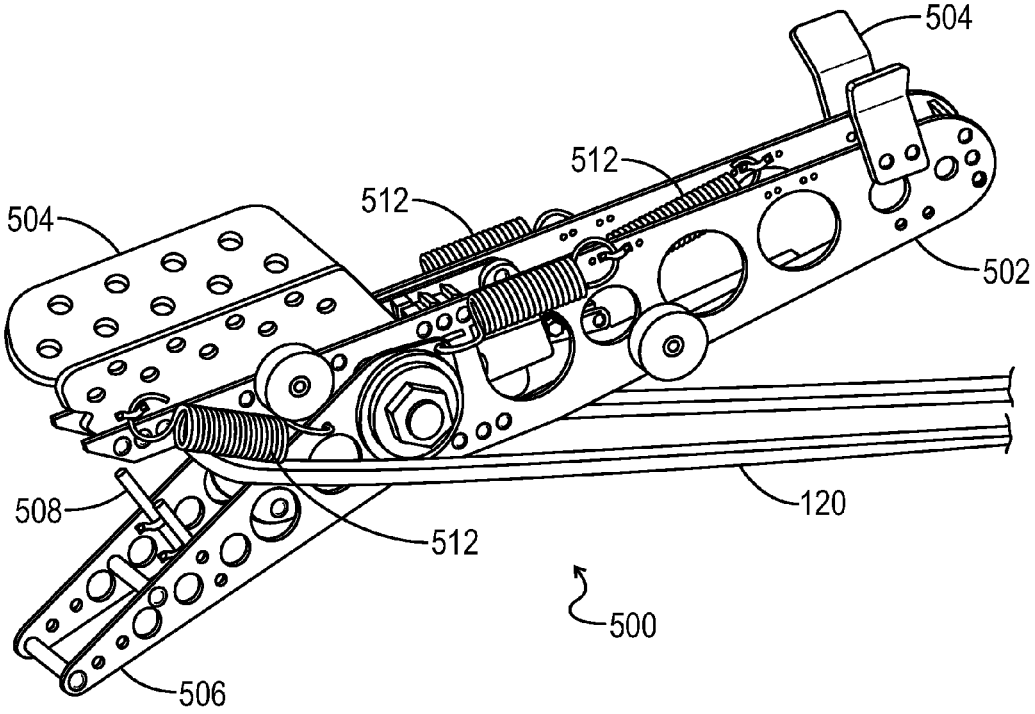
FIG. 3 is a perspective view of a spring-loaded towing latch for use in the vehicle recovery system.

Other types and arrangements of spring-loaded towing latches can be used. In general, the towing latch 106 is biased open and closes upon engagement of a capture loop 120. As illustrated in FIG. 3, another embodiment of a spring-loaded towing latch 500 is illustrated. A main body 502 of the towing latch 500 is mounted to the recovery vessel 300 by using one or more mounts 504. A hook 506 of the towing latch 500 is pivotally mounted to the body 502 and is biased open until engagement of one or more capture loops 120 around the hook. The towing latch 500 includes a plurality of springs 512 to bias the hook 506 open or closed to secure the capture loops 120. A rod 508 is also provided and attached to the hook 506 to facilitate capture of the capture loops 120 and to prevent the capture loops from disengaging from the hook.

Recovery methods will rely on operator visual detection. Sensors and lasers can provide a spatial reference that can assist or even replace visual detection during. The capture device 104 has the advantage of being able to produce a highly visible wake to aid the operator in aiming for the final docking maneuver. Furthermore, the capture device 104 can be towed alone or coupled to other recovery equipment.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s). Therefore, it will be understood that the appended claims are intended to cover all such modifications and embodiments, which would come within the spirit and scope of the present invention.

What is claimed is:

1. A capture device comprising:

a U-shaped body having two arms defining a cavity therebetween;

a shaft attached to one of said arms and extending through the cavity to attach to another of said arms;

a buoyant member with a first end and a second end disposed in the cavity and rotatable around said shaft; and a plurality of capture loops with each of said capture loops having a first end and a second end with a first end of said capture loop attachable to a first end of said buoyant member and a second end of said capture loop attachable to a second end of said buoyant member wherein said capture loops are rotatable with said buoyant member.

2. The capture device of claim 1, wherein said buoyant member comprises a cylindrical drum with a central axis between the first and second ends of said cylindrical drum, said shaft extending through the first and second ends along the central axis.

3. The capture device of claim 2, wherein each of said capture loops comprises a curved rod attached to an outer surface of said cylindrical drum at two locations, a first location disposed adjacent the first end of said cylindrical drum and a second location disposed adjacent the second end of said cylindrical drum; and wherein each curved rod of said capture loops extends along the outer surface of the cylindrical drum along a line parallel to the central axis and extends radially outward from outer surface of the cylindrical drum.

4. The capture device of claim 1, further comprising at least one paddle attached to and extending out from said buoyant member, said at least one paddle separate from said capture loops.

5. The capture device of claim 4, wherein:

said buoyant member comprises a cylindrical drum comprising two ends, a central axis passing through said cylindrical drum between the first and second ends, said shaft extending through the first and second ends along the central axis; and wherein each paddle comprises a plate extending radially outward from the outer surface of said cylindrical drum.

6. The capture device of claim 5, wherein each paddle comprises a central portion attached to said buoyant member and two parallel plates extending outwardly from the central portion in parallel planes.

7. The capture device of claim 6, wherein each pair of said parallel plates comprises a first plate that extends outwardly from the central portion at a first distance and a second plate that extends outwardly from the central portion at a second distance, the first distance being greater than the second distance.

8. A system for recovery of a vehicle, said system comprising:

a capture device with a U-shaped body having two arms defining an open ended cavity with a shaft attached to one of said arms and extending through the cavity to attach to another of said arms, a buoyant member disposed in the cavity and rotatable around said shaft and a tow line attached to said body opposite the cavity with a plurality of capture loops disposed within the cavity and rotatable with said buoyant member; and a spring-loaded towing latch attachable to the vehicle, said towing latch comprising a hook with a first open position and a second closed position, said hook moveable from a first position to a second position under action of a biasing spring upon engagement of one of said capture loops captured by said hook.

9. The system of claim 8, wherein said hook comprises a primary latch that is capable of forming a funnel, a stem guard of said towing latch to capture one of said capture loops with said hook pivotable away from said stem guard; and wherein said latch further comprises a secondary latch attached to said hook and biased in a locked position away from said hook by a biasing spring with said secondary latch capable of moving toward said hook to allow passage of one of said capture loops through the funnel.

10. The system of claim 9, wherein said buoyant member comprises a cylindrical drum with two ends, a central axis passing through said drum between the two ends and an outer surface, said shaft extending to the two ends along the central axis.

11. The system of claim 10, wherein each capture loop comprises a curved rod attached to the outer surface of the cylindrical drum at two locations, a first location disposed adjacent to a first end of said drum and a second location disposed adjacent to a second end of said drum.

12. The system of claim 11, further comprising at least one paddle attached to and extending out from said buoyant member, with each paddle having a plate extending radially outward from and along the outer surface of said drum between the two ends and parallel to the central axis.

* * * * *